US005392017A

United States Patent [19]

Oter Munoz et al.

[11] Patent Number: 5,392,017

[45] Date of Patent: Feb. 21, 1995

[54] CHOKE COIL COMPRISING A BEAD OF A SOFT-MAGNETIC MATERIAL

[75] Inventors: Manuel Oter Muñoz; Pedro M. Cortes Morales, both of Guadalajara; Maria I. Herrero Gonzales, Salamanca; Jose M. Esteban Pico, Azuqueca De Henares Guadalajara, all of Spain

[73] Assignee: U.S. Philips Corporation, New York, N.Y.

[21] Appl. No.: 238,391

[22] Filed: May 3, 1994

Related U.S. Application Data

[63] Continuation of Ser. No. 730,312, Jul. 15, 1991, abandoned.

[30] Foreign Application Priority Data

Jul. 30, 1990 [NL] Netherlands ..... 9001717
Jul. 30, 1990 [NL] Netherlands ..... 9001718

[51] Int. Cl.[6] ..... H01F 17/04; H01F 27/24

[52] U.S. Cl. ..... 336/83; 174/91; 336/90; 336/192; 336/221; 336/233

[58] Field of Search ..... 336/83, 175, 221, 233, 336/90, 192; 174/52.1, 74 R, 74 A, 93, 91

[56] References Cited

U.S. PATENT DOCUMENTS 2,943,140 6/1960 Bander ..... 174/93
4,656,451 4/1987 Pomponio ..... 336/175
4,972,459 11/1990 Sommer ..... 336/175

FOREIGN PATENT DOCUMENTS 2352872 4/1975 Germany ..... 336/83
3602759 8/1987 Germany .
62-245608 10/1987 Japan .
2162000 1/1986 United Kingdom ..... 174/93

OTHER PUBLICATIONS

RCA Technical Notes No. 704, Jan. 1967, "VHF/UHF Balum" Steven Wlasuk.

Philips Components and Materials Handbook C5, Apr. 1986, Fig. 5, p. 335.

*Primary Examiner*—Thomas J. Kozma
*Attorney, Agent, or Firm*—Laurie Gathman

[57] ABSTRACT

The choke coil comprises a bead of a soft-magnetic material in which a number of ducts extend in parallel. An electrically conductive wire comprising fee ends is accommodated in the ducts. The choke coil comprises means for shielding a portion of the turn which extends outside the ducts. To this end, for example an electrically insulating housing is arranged around the bead. The housing consists of two approximately cylindrical portions, each of which comprises a substantially closed end face which is situated on a first end portion. The cylindrical portions are axially slid over the bead with their second open end portion fitting one into the other. In each end face there is provided at least one opening for feeding out the wire. When the choke coil is also provided with electrically insulating caps having a wire passage in the prolongation of the axis of the bead, the wire fed out will be oriented along said axis.

4 Claims, 4 Drawing Sheets

CHOKE COIL COMPRISING A BEAD OF A SOFT-MAGNETIC MATERIAL

This is a continuation of application Ser. No. 07/730,312, filed Jul. 15, 1991, now abandoned.

BACKGROUND OF THE INVENTION

The invention relates to a choke coil, comprising a bead of a soft-magnetic material in which a number of ducts extend with mutually parallel axes from a first end face to a second end face in order to accommodate an electrically conductive wire having free ends, said wire forming a number of turns, each of which extends via at least two ducts.

The invention also relates to a bead and a cylindrical portion and cap suitable for use in a choke coil in accordance with the invention.

A choke coil of the kind set forth is known from Philips Components and Materials Handbook C5, Apr. 1986, FIG. 5, page 335.

In the known choke coil there is a risk of short-circuiting between the portion of the turns which projects from the bead and other conductors, for example, the tracks on a printed circuit board (PCB) or the free ends of the wire itself whereby the bead can be mounted on a PCB.

It is an object of the invention to provide a choke coil of the kind set forth in which the described drawback is mitigated. To achieve this, the choke coil in accordance with the invention is characterized in that the choke coil comprises a device for shielding a portion of the turn which extends outside the ducts.

The risk of contacting of other conductors is thus comparatively small, so that the risk of short-circuiting is strongly reduced.

A preferred embodiment of the choke coil in accordance with the invention is characterized in that the device comprises an electrically insulating housing which tightly fits around the bead and which includes an inner, approximately cylindrical portion and an outer, approximately cylindrical portion, each portion comprising a substantially closed end face on a first end portion and being axially slid over the bead with their open end portions fitting one into the other.

This is a first method of realizing the shielding. The bead and the projecting portion of the turns are shielded by the housing.

It is to be noted that the use of a housing for keeping two components together is known per se from the abstract in English of JP-A 62-245608.

A further embodiment of the choke coil in accordance with the invention is characterized in that the housing is provided with at least two openings wherethrough the free ends of the wires are fed out.

The choke coil can be mounted on a PCB by way of the free ends of the wire which are fed out Via openings in the housing.

A further embodiment of the choke coil in accordance with the invention is characterized in that the openings are provided in the end face of the cylindrical portions in the prolongation of the ducts wherefrom the free ends of the wire project from the bead.

The portions of the housing can thus be readily slid over the bead.

Depending on the desired construction of the choke coil, the free ends are fed out either via a respective opening in oppositely situated end faces of the housing or via two openings in one and the same end face of the housing.

A further embodiment of the choke coil in accordance with the invention is characterized in that an electrically insulating cap is arranged over the first end portion of each of the cylindrical portions, which cap is provided with a wire passage in the prolongation of the axis of the bead.

The wire can thus be fed out of the bead along the axis of the bead.

Another embodiment of the choke coil in accordance with the invention is characterized in that the two cylindrical portions are connected to one another by way of a snap connection.

The two cylindrical portions are thus firmly retained around the bead. The snap connection is preferably realized by cooperation between a ridge on a wall of the outer cylindrical portion which faces the inner cylindrical portion and the flared second end portion of the inner cylindrical portion.

A further embodiment of the choke coil in accordance with the invention is characterized in that the caps are secured on the first end portions of the cylindrical portions by way of a snap connection. The snap connection is preferably realized by cooperation between a ridge on a wail of the cap which faces the cylindrical portion and the flared first end portion of the cylindrical portion.

As a result, the caps are firmly attached to the end faces of the housing.

An alternative embodiment of the choke coil in accordance with the invention is characterized in that the devices formed by a recess provided in at least the first end face of the bead, which recess is situated between two ducts and interconnects the two ducts, a portion of the wire extends through the recess and the recess has a depth which is greater than the transverse dimension of the wire.

At the end face of the bead wherefrom the free ends of the wire project, the turns are situated in a recess, so that they remain fully within the bead and no longer give rise to short-circuiting.

A further embodiment of the choke coil in accordance with the invention is characterized in that the bead is provided with two diametrically oppositely situated flat faces which extend parallel to the ducts.

Because the bead comprises flat faces, it can be readily gripped for mounting on a PCB. It is to be noted that a choke coil comprising flat faces is known per se.

A further embodiment in accordance with the invention is characterized in that the axes of the ducts wherethrough the free ends of the wire project from the bead are situated in a plane substantially parallel to the flat faces. Because the free ends of the wire are situated in a plane parallel to the flat faces of the bead, the choke coil can be positioned with respect to a PCB utilizing said flat faces so that the choke coil can be automatically positioned.

BRIEF DESCRIPTION OF THE DRAWINGS

The invention will be described in detail hereinafter with reference to the drawings.

DETAILED DESCRIPTION OF THE DRAWINGS

Figure 1:
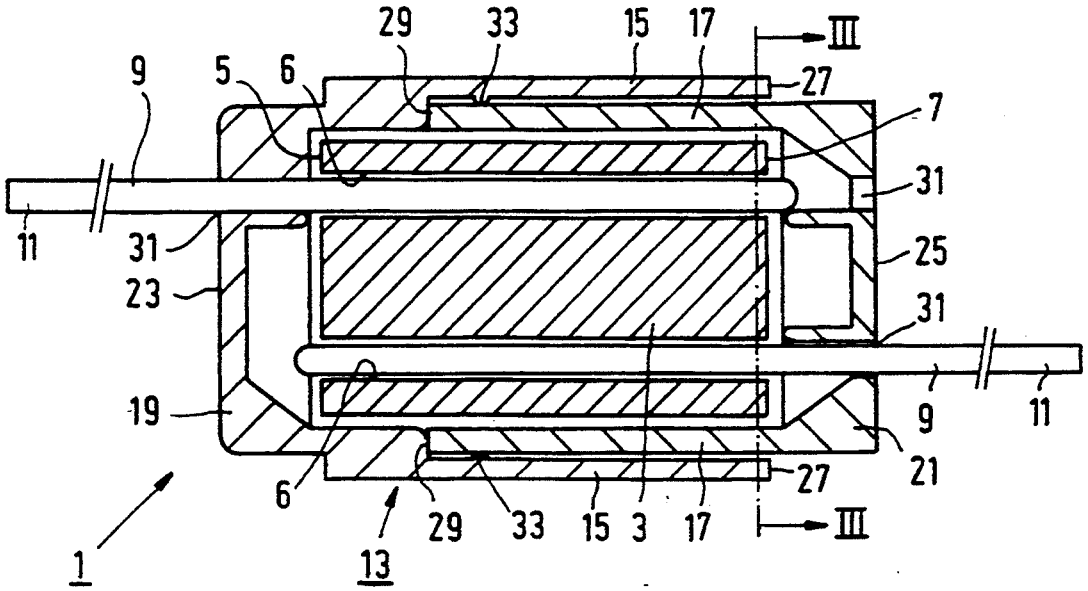
FIG. 1 is a longitudinal sectional view of a first embodiment of a choke coil in accordance with the invention.

The choke coil 1 shown in FIG. 1 comprises a bead 3 of a soft-magnetic material, for example ferrite, which serves as a core. The bead 3 is provided with a number of ducts 6 which extend in parallel from a first end face 5 to a second end face 7. The ducts 6 accommodate an electrically conductive wire 9 having free ends 11 which project from the bead 3 at the first end face 5 and the second end face 7. The Figure shows only the two ducts 6 via which the wire 9 is fed out of the bead 3. Around the bead 3 there is provided an electrically insulating housing 13. The housing 13 is preferably made of a polyamide capable of withstanding high operating temperatures, for example from 100° to 120° C. The housing 13 consists of an outer cylindrical portion 15 and an inner cylindrical portion 17. Each of the portions 15, 17 comprises a first end portion 19, 21 having a substantially closed end face 23, 25. The cylindrical portions 15, 17 also comprise a second, open end portion 27, 29 so that they fit one into the other in the axial direction so as to be slid over the bead 3. The first end face 23 and the second end face 25 are each provided with at least one opening 31 for feeding out the free ends 11 of the wire 9. The openings 31 are situated in the prolongation of the ducts 6 in the bead 3 via which the free ends 11 project from the bead 3.

Figure 1A:
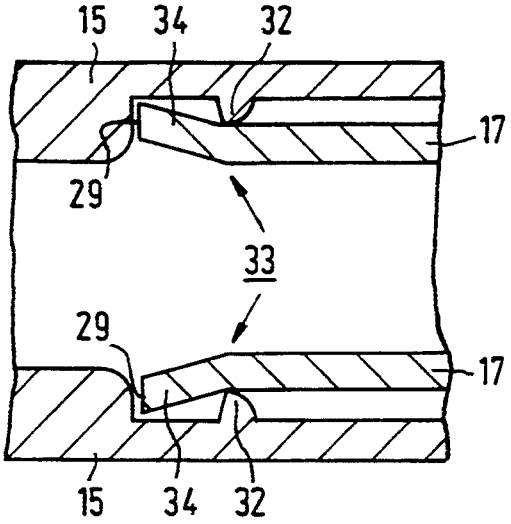
FIG. 1*a* is a detailed longitudinal sectional view, taken at the area of the snap connection, of a portion of the choke coil shown in FIG. 1.

The cylindrical portions 15, 17 are connected to one another by way of a snap connection 33 so that the two portions 15, 17 can be firmly secured around the bead 3. FIG. 1a shows the snap connection 33 in detail. The wall of the inner cylindrical portion 17 has a flared shape at its second, open end portion 29. The thickness of the wall of the inner cylindrical portion 17 is comparatively small, so that it is slightly resilient. The outer cylindrical portion 15 is provided with a ridge 32 on the wall facing the inner portion 17. When the two cylindrical portions 15, 17 are pressed one into the other with a comparatively large force, the flared portion 34 is distorted so that it can pass the ridge 32. Thanks to the resilience of the material, the portion 34 regains its original shape after having passed the ridge 32. The two portions 15, 17 have thus become inseparable.

Figure 2:
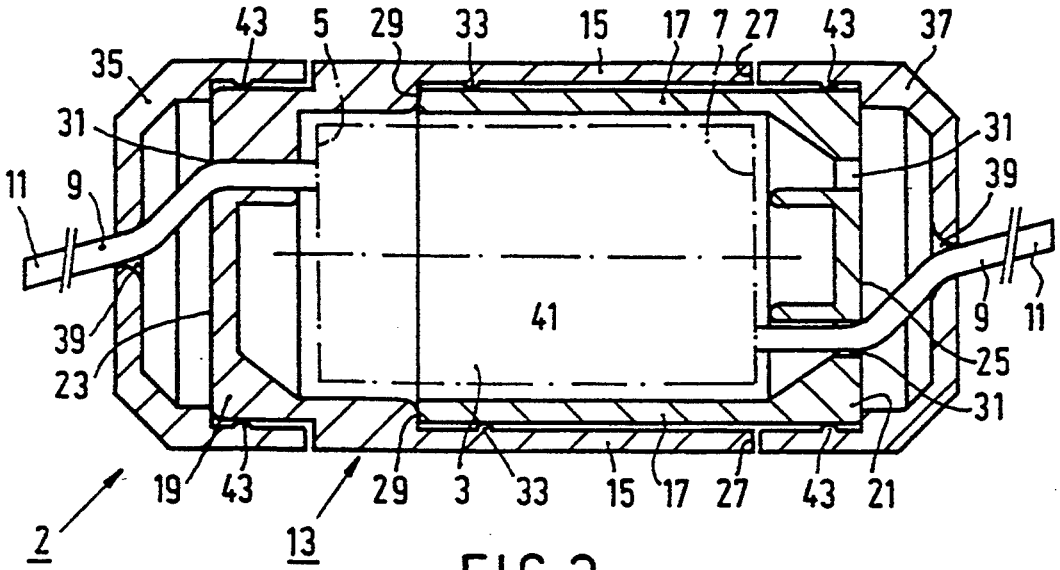
FIG. 2 is a longitudinal sectional view of a second embodiment of a choke coil in accordance with the invention.

The choke coil 2 shown in FIG. 2 comprises two electrically insulating caps 35, 37 in addition to the insulating housing 13 of the choke coil 1 of FIG. 1. The bead 3 is now represented by a broken line. The ducts 6 extend in the same way through the bead 3 as in the choke coil shown in FIG. 1. A cap 35, 37 is arranged over each first end portion 19, 21 of the portions 15, 17 of the housing 13, which cap is provided with a wire passage 39 in the prolongation of the axis 41 of the bead 3. The wire 9 can thus be fed out of the housing 13 in the prolongation of the axis 41. The two caps 35, 37 are also secured on the housing 13 by means of a snap connection 43 in order to obtain a rugged construction. This snap connection 43 functions according to the same principle as the already described snap connection 33. In this case the resilience required for the snap connection 43 resides mainly in the thin-walled caps 35, 37.

Figure 3:
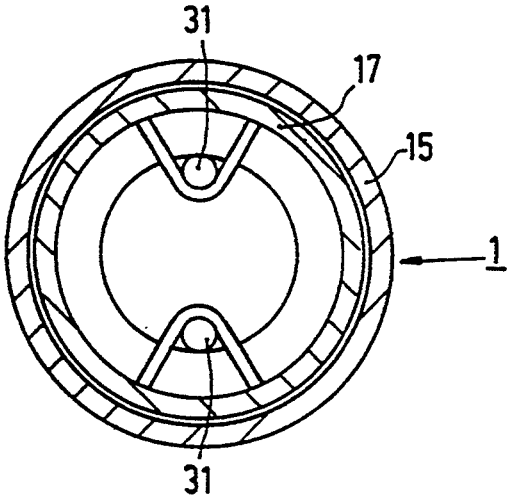
FIG. 3 is a cross-sectional view of the choke coils shown in the FIGS. 1 and 2.

FIG. 3 is a cross-sectional view of the choke coil shown in FIG. 1, taken along the line III—III. A cross-sectional view taken along an identical line in FIG. 2 offers the same result.

Figure 4:
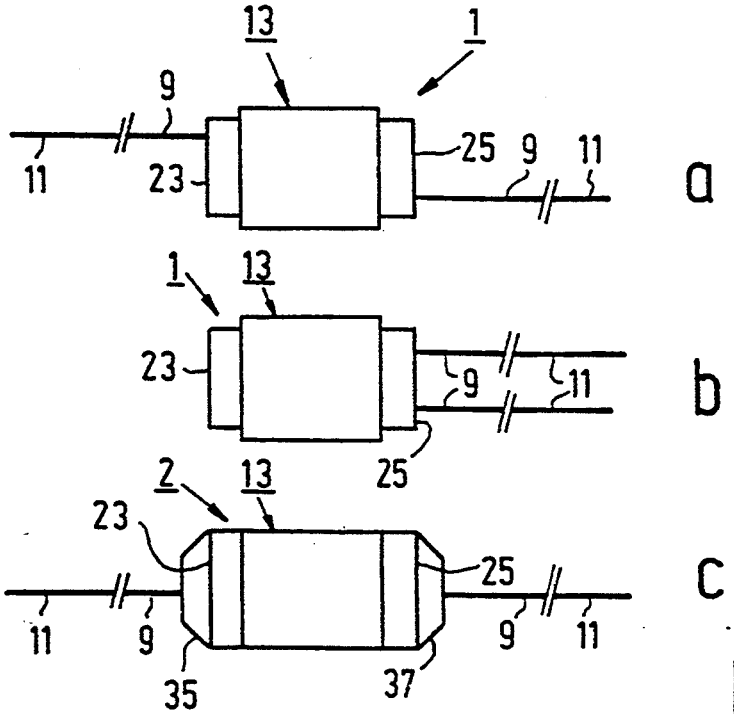
FIG. 4a–4c shows some feasible embodiments of choke coils in accordance with the invention.

The choice of the number of openings 31 (one or two) in the end faces 23, 25 of the portions 15, 17 of the housing 13, via which the wire 9 is fed out of the housing 13, allows for different versions of the choke coil as shown in FIG. 4.

In the choke coil shown in FIG. 4a, a free end 11 projects from the housing 13 at each of the two end faces 23, 25. This is a choke coil as shown in FIG. 1 in which the number of turns in the choke coil is not an integer. In FIG. 4b two openings 31 are provided in the same end face 25 of the choke coil shown in FIG. 1 for feeding out the free ends 11. This is the case when the choke coil comprises an integer number of turns.

Figure 5:
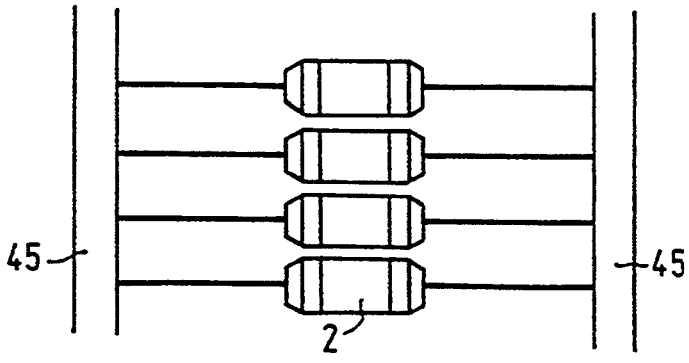
FIG. 5 shows choke coils in accordance with the invention arranged on a tape.

Finally, in the version shown in FIG. 4c, the choke coil comprises the insulating caps 35, 37 as shown in FIG. 2. The free ends 11 of the wire 9 are now situated in the prolongation of the axis 41 of the bead. This construction is feasible only for a choke coil comprising a non-integer number of turns. For packing and transport, the choke coils 2 are preferably disposed on a tape 45 as shown in FIG. 5.

Figure 6:
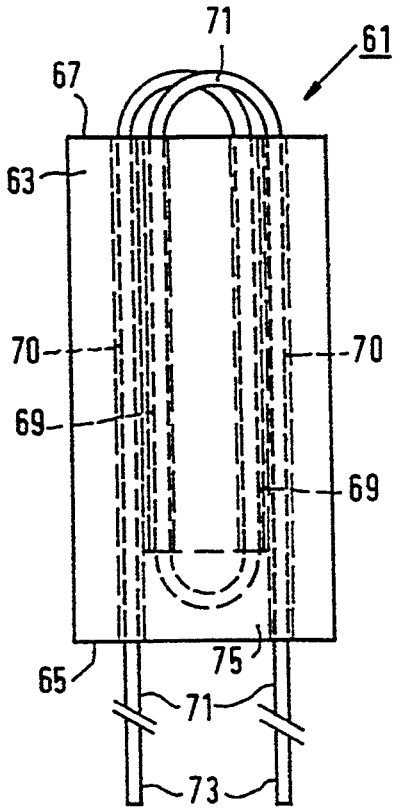
FIG. 6 is a side elevation of an embodiment of a choke coil in accordance with the invention.

The choke coil 61 shown in FIG. 6 comprises, like the choke coil 1 shown in the FIGS. 1 to 5, a bead 63 of a soft-magnetic material, for example ferrite, which serves as a core. The bead 63 comprises a first end face 65 and a second end face 67 wherebetween a number of ducts 69, 70 extend so as to accommodate an electrically conductive wire 71 having free ends 73. The free ends 73 of the wire 71 extend through the ducts 70 and project from the first end face 65 of the bead 63. In the first end face 65 of the bead 63 there is provided a recess 75 which interconnects the ducts 69.

Figure 7:
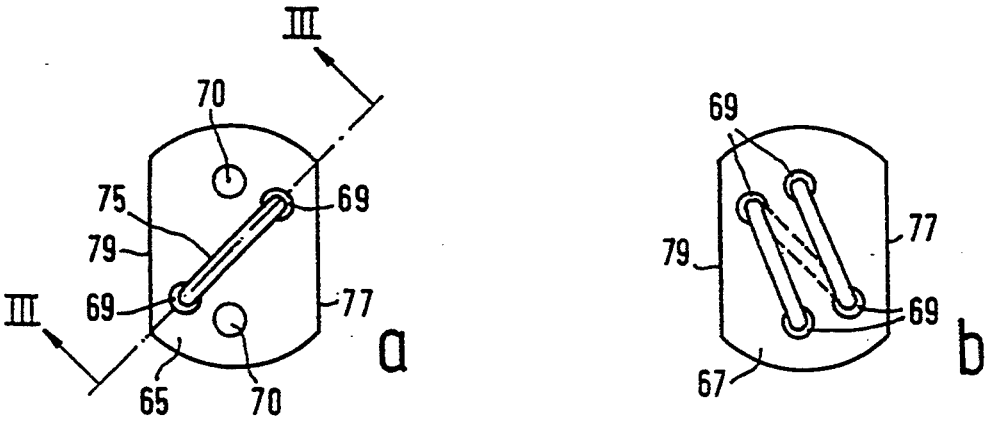
FIGS. 7a and 7b are a bottom view and a plan view, respectively, of the choke coil shown in FIG. 6.

FIG. 7a is a bottom view of the bead 63 and FIG. 7b is a plan view of the bead 63.

Figure 8:
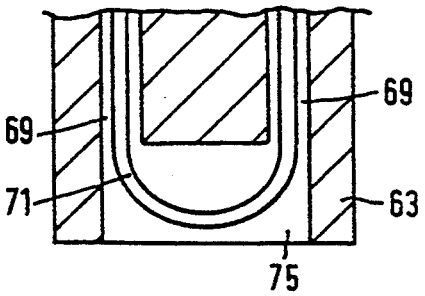
FIG. 8 is a detailed, partial longitudinal sectional view of a recess in the bead of the choke coil as shown in FIG. 6.
Figure 9:
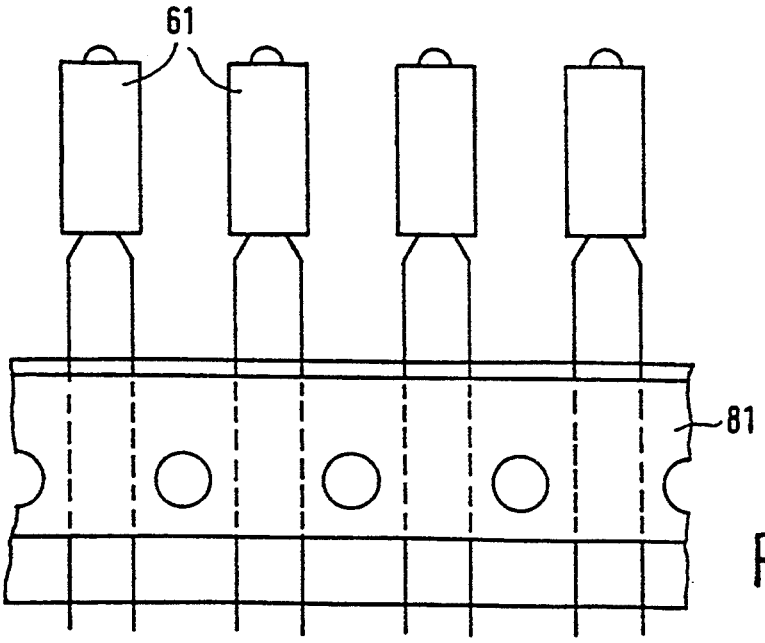
FIG. 9 shows choke coils in accordance with the invention arranged on a tape.

FIG. 8 is a longitudinal sectional view at an increased scale of the recess 75 in the first end face 65, taken along the line III—III in FIG. 7a. The recess is proportioned so that a winding which interconnects two ducts 69 wherebetween the recess 75 is provided is situated completely within the bead 63. The risk of short-circuiting is thus strongly mitigated. FIGS. 7a and 7b clearly show that the bead 63 comprises two flat faces 77 and 79 which are diametrically oppositely situated. The bead 63 can thus be readily gripped by an appropriate tool which, for example forms part of a machine for the automatic mounting of components on a PCB (not shown). The faces 77 and 79 extend parallel to the ducts 70. Moreover, the axes of the ducts 70 and the free ends 73 projecting from said ducts 70 are situated in a plane extending substantially parallel to the flat faces 77, 79. This allows for the choke coils 61 to be arranged on a tape 81 for packaging and transport as shown in FIG. 9. Furthermore, for the mounting of choke coils on a PCB the fact that the flat faces 77, 79 and the plane in which the free ends 73 are situated extend in parallel can be used for positioning the choke coils 61 with respect to a PCB, so that this operation can be automatically performed.

The described embodiment of the choke coil comprises two turns. Only one turn extends via the first end face 65 between two ducts 69. However, it is alternatively possible to manufacture choke cods comprising three or more turns. In that case the bead 63 must comprise four or more ducts 69 which are interconnected two-by-two by recesses 75 in the first end face 65. These recesses 75 may be separated by ridges of the material used to manufacture the bead. Alternatively, however, the ducts 69 may also open into one large recess.

In the described embodiment only the first end face 65 is provided with a recess 75. If desirable, recesses 75 can also be provided in the second end face 67 in order to prevent short-circuits also at that area.

We claim:

1. A choke coil, comprising:

a) a bead of a soft-magnetic material having first and second opposing end faces and a plurality of ducts extending therethrough with mutually parallel axes between said end faces;

b) a single length of uninsulated electrically conductive wire having free ends, said length of wire extending through said ducts and forming a number of turns about said bead, said turns having turn portions which extend adjacent said bead end faces exterior to said ducts, said length of wire extending through said ducts such that at least one of (i) a plurality of exterior turn portions and (ii) an exterior turn portion and a free end of said wire extend adjacent each of said end faces; and c) shielding means for preventing electrical contact between any of (i) the exterior turn portions from each other and (ii) the exterior turn portion and the free end from each other, said shielding means being formed by a recess in the end faces, and said exterior turn portions extending through the recess which recess has a depth greater than the transverse dimension of the wire.

2. A choke coil as claimed in claim 1, wherein the axes of the ducts wherethrough the free ends of the wire project from the bead are situated in a plane substantially parallel to the flat faces.

3. A choke coil as claimed in claim 1, wherein said bead includes a pair of flat faces situated diametrically opposite each other and extending parallel to the ducts.

4. A bead of a soft-magnetic material having first and second opposing end faces and a plurality of ducts extending therethrough with mutually parallel axes between said end faces, said bead for use in a choke coil comprising:

a) a single length of uninsulated electrically conductive wire having free ends, said length of wire extending through said ducts and forming a number of turns about said bead, said turns having turn portions which extend adjacent said bead end faces exterior to said ducts, said length of wire extending through said ducts such that at least one of (i) a plurality of exterior turn portions and (ii) an exterior turn portion and a free end of said wire extend adjacent each of said end faces; and b) shielding means for preventing electrical contact between any of (i) the exterior turn portions from each other and (ii) the exterior turn portion and the free end from each other, said shielding means being formed by a recess in the end faces, and said exterior turn portions extending through the recess which recess has a depth greater than the transverse dimension of the wire.

* * * * *